United States Patent [19]

Schulz et al.

[11] 4,403,998

[45] Sep. 13, 1983

[54] PROCESS FOR PREPARING COAL SUSPENSIONS

[75] Inventors: Johann G. D. Schulz, Pittsburgh; John A. Cobler, Harwick, both of Pa.

[73] Assignee: Gulf Research & Development Company, Pittsburgh, Pa.

[21] Appl. No.: 334,159

[22] Filed: Dec. 24, 1981

[51] Int. Cl.[3] ..... C10L 1/22

[52] U.S. Cl. ..... 44/51

[58] Field of Search ..... 44/51, 1 SR; 201/17; 406/197, 86, 46, 47, 48, 49

[56] References Cited

U.S. PATENT DOCUMENTS

| | | | |
|---|---|---|---|
| 3,393,978 | 7/1968 | Murphy et al. | 201/17 |
| 3,993,455 | 11/1976 | Reggel et al. | 201/17 |
| 4,188,191 | 2/1980 | Longanbach et al. | 44/1 SR |
| 4,204,840 | 5/1980 | Yoo et al. | 201/17 |
| 4,213,765 | 7/1980 | Wilson | 201/17 |

*Primary Examiner*—Charles F. Warren
*Assistant Examiner*—Y. Harris-Smith
*Attorney, Agent, or Firm*—Deane E. Keith; Forrest D. Stine; Jos. J. Carducci

[57] ABSTRACT

A process for preparing coal suspensions which comprises contacting coal with nitric acid and then combining said contacted coal with an aqueous base solution.

17 Claims, No Drawings

PROCESS FOR PREPARING COAL SUSPENSIONS

BACKGROUND OF THE INVENTION

1. Field of the Invention

This invention relates to a process for preparing coal suspensions which comprises contacting coal with nitric acid and then combining said contacted coal with an aqueous base solution.

2. Description of the Prior Art

In our U.S. Pat. No. 4,261,701, dated Apr. 14, 1981, we have disclosed (I) a suspension containing (1) coal, (2) water and (3) the product resulting from the reaction of (a) polycyclic, polycarboxylic acids obtained as a result of the oxidation of coal with (b) a base and (II) a process for preparing such suspension. In the process defined in said patent, we mixed (A) an aqueous mixture containing (1) the product resulting from the reaction of (a) polycyclic, polycarboxylic acids obtained as a result of the oxidation of coal with (b) a base with (B) coal.

SUMMARY OF THE INVENTION

We have discovered a unique process for preparing coal suspensions which comprises contacting coal with nitric acid and then combining said contact coal with an aqueous base solution.

Any suitable or conventional coal can be used herein in the preparation of the defined suspensions. Bituminous and subbituminous coals, lignitic materials and other types of coal products are exemplary of coals that are suitable herein. The carbon and hydrogen content of the coal are believed to reside primarily in multi-ring aromatic and non-aromatic compounds (condensed and/or uncondensed), heterocyclic compounds, etc. On a moisture-free, ash-free basis the coal can have the following composition:

TABLE I

| | Weight Percent | |
|---|---|---|
| | Broad Range | Preferred Range |
| Carbon | 45–95 | 60–85 |
| Hydrogen | 2.2–8 | 5–7 |
| Oxygen | 2–46 | 8–40 |
| Nitrogen | 0.7–3 | 1–2 |
| Sulfur | 0.1–10 | 0.2–5 |

Some of these coals in their raw state can contain relatively large amounts of water. They can be dried prior to use, if desired, and preferably ground in a suitable attrition machine, such as a hammermill, to a size, for example, such that at least about 50 weight percent of the coal will pass through a 40-mesh (U.S. Series) sieve. In general, the coal particles can vary over a wide range, for example, from particles whose average length can be about one inch (2.54 cm) or more to as small as about 500 mesh, although in general the average length will probably be no longer than about one-half inch (1.27 cm) but no smaller than about 200 mesh.

The initial step herein involves contacting said coal with aqueous nitric acid. Any procedure that will enable the nitric acid to contact a large amount of the surface area of the coal will suffice. A preferred procedure involves spraying nitric acid onto a moving bed of coal, for example, on a conveyor. The concentration of the aqueous nitric acid used herein will vary from about 15 to about 90 weight percent, but generally will be in the range of about 25 to about 70 weight percent. The weight ratio of nitric acid (as 100 weight percent nitric acid) to coal (on a moisture-free, ash-free basis) can be in the range of about 1:90 to about 1:4, preferably about 1:45 to about 1:10. The coal is preferably contacted with the nitric acid at ambient conditions of temperature and pressure, although the temperature of the coal can be as high as about 100° C., if desired.

The second step involved herein merely requires that the coal so contacted above be combined, for example, by mixing, with an aqueous base solution. The base in the aqueous base solution can include any base, including the corresponding or basic salt, organic or inorganic, that is substantially soluble in water and capable of reacting with a carboxyl group. Thus, hydroxides of the elements of Group IA and Group IIA of the Periodic Table can be used. Of these we prefer to use potassium, sodium or calcium hydroxide. In addition ammonium hydroxide can also be used. Among the organic bases that can be used are aliphatic amines having from one to 12 carbon atoms, preferably from one to six carbon atoms, such as methylamine, ethylamine, ethanolamine and hexamethylenediamine, aromatic amines having from six to 60 carbon atoms, preferably from six to 30 carbon atoms, such as aniline and naphthylamine, aromatic structures carrying nitrogen as a ring constituent, such as pyridine and quinoline, etc. By "basic salt" we mean to include salts of the elements of Group IA and IIA of the Periodic Table whose aqueous solutions exhibit a pH in the basic region, such as potassium carbonate, sodium metasilicate, calcium acetate, barium formate, etc. In a preferred embodiment, coal on a moving conveyor that has been contacted with nitric acid, as defined above, is introduced into an aqueous base solution while stirring.

The weight ratio of treated coal to water can be in the range of about 3:1 to about 1:3, preferably about 2.5:1 to about 1:2.5, while the weight ratio of treated coal to base can be in the range of about 90:1 to about 4:1, preferably about 70:1 to about 20:1. Bringing the coal in contact with the aqueous base solution can preferably be done at ambient conditions of temperature and pressure, although the temperature of the aqueous base solution can be as high as about 100° C. Mixing of the treated coal can be continued, for example, from about 0.01 to about 10 hours, sufficient to obtain the desired suspension. Mixing can be effected in any suitable manner, for example, using propeller agitation, turbine agitation, colloid mill, etc.

If desired, the treated coal and the aqueous base solution can be combined in a series of steps, provided the final product, or suspension, contains the components in the weight ratios defined above.

The suspensions so prepared are stable, that is there is no separation of water from the coal, and there is no agglomeration of coal into larger size entities. When desired, however, the suspensions herein can easily be broken, for example, mechanically, by bringing the same into contact with a body, for example, filter, or chemically, for example, by contact with an acid solution, such as aqueous hydrochloric acid. Substituting bituminous coal for the lignite in the above runs will give substantially similar results.

DESCRIPTION OF PREFERRED EMBODIMENTS

EXAMPLE I 60.0 grams of North Dakota lignite was spread over the bottom of a 1000 milliliter beaker which had a bottom surface area of 80 square centimeters. The North Dakota lignite used analyzed as follows:

33 wt % water;
45.7 wt % carbon;
2.8 wt % hydrogen;
11.3 wt % oxygen;
0.6 wt % sulfur;
0.6 wt % nitrogen; and
6.0 wt % metals.

Over a period of two minutes, two milliters of 70 percent aqueous nitric acid was added dropwise evenly over the lignite. The treated coal was permitted to stand for 15 minutes and then blended into 72 milliliters of water containing 2.5 grams of sodium hydroxide in a Waring blender operating at about 20,000 revolutions per minute for 10 minutes.

EXAMPLE II

The procedure of Example I was followed in that 120 grams of North Dakota lignite was spread over the bottom of the flask and 10 milliliters of 35 percent aqueous nitric acid was added thereto over a period of five minutes. After 30 minutes the treated coal was added to 200 milliliters of water containing 10 grams of sodium hydroxide and blended as in Example I.

EXAMPLE III

Example II was repeated except that the water contained five grams of sodium hydroxide.

The data obtained are summarized below in Table II:

TABLE II

| Ex. No. | Grams of Coal, Dry Basis | Grams of $HNO_3$ as 100% $HNO_3$ | Grams $H_2O$ | Grams NaOH | Stability, Days[1] |
|---|---|---|---|---|---|
| I | 43.8 | 2.0 | 72 | 2.5 | 4 |
| II | 87.6 | 5.0 | 200 | 10 | 30 |
| III | 87.6 | 5.0 | 200 | 5 | 30 |

[(1)]Last day of observation; no settling of coal particles noted.

The data in Table II clearly exemplify the stability of the coal suspensions claimed herein.

Obviously, many modifications and variations of the invention, as hereinabove set forth, can be made without departing from the spirit and scope thereof and therefore only such limitations should be imposed as are indicated in the appended claims.

We claim:

1. A process for preparing coal suspensions which comprises contacting coal with nitric acid and then mixing said contacted coal with an aqueous base solution.

2. The process of claim 1 wherein said nitric acid has a concentration of about 15 to about 90 percent.

3. The process of claim 1 wherein said nitric acid has a concentration of about 25 to about 70 weight percent.

4. The process of claim 1 wherein the weight ratio of said nitric acid to said coal is in the range of about 1:90 to about 1:4.

5. The process of claim 1 wherein the weight ratio of said nitric acid to said coal is in the range of about 1:45 to about 1:10.

6. The process of claim 1 wherein said coal is lignite.

7. The process of claim 1 wherein said coal is bituminous.

8. The process of claim 1 wherein said coal being contacted has a particle size of about one inch to about 500 mesh.

9. The process of claim 1 wherein said coal being contacted has a particle size of about one-half inch to about 200 mesh.

10. The process of claim 1 wherein said aqueous base solution is an organic base solution.

11. The process of claim 1 wherein said aqueous base solution is an inorganic base solution.

12. The process of claim 1 wherein said aqueous base solution is one containing a hydroxide of an element of Group IA of the Periodic Table.

13. The process of claim 1 wherein said aqueous base solution is one containing sodium hyroxide.

14. The process of claim 1 wherein the weight ratio of the treated coal to water in said aqueous base solution is in a weight ratio of about 3:1 to about 1:3.

15. The process of claim 1 wherein the weight ratio of the treated coal to water in said aqueous base solution is in a weight ratio of about 2.5:1 to about 1:2.5.

16. The process of claim 1 wherein the weight ratio of treated coal to base in said aqueous base solution is in a weight ratio of about 90:1 to about 4:1.

17. The process of claim 1 wherein the weight ratio of treated coal to base in said aqueous base solution is in a weight ratio of about 70:1 to to about 20:1.

* * * * *